United States Patent [19]

Plummer

[11] Patent Number: 4,555,093

[45] Date of Patent: Nov. 26, 1985

[54] CABLE PULLING DEVICE WITH FORCE INDICATOR AND OVERLOAD PROTECTION

[75] Inventor: Jeffrey J. Plummer, Rockford, Ill.

[73] Assignee: Ex-Cell-O Corporation, Troy, Mich.

[21] Appl. No.: 642,916

[22] Filed: Aug. 21, 1984

Related U.S. Application Data

[63] Continuation of Ser. No. 435,172, Oct. 19, 1982, abandoned.

[51] Int. Cl.[4] ..... B66D 1/12; B66D 3/16; B66D 3/20

[52] U.S. Cl. ..... 254/362; 254/275; 254/358; 254/380

[58] Field of Search ..... 254/362, 274, 275, 358, 254/376, 380; 318/490; 361/31

[56] References Cited

U.S. PATENT DOCUMENTS

| | | | |
|---|---|---|---|
| 2,221,903 | 7/1937 | Abramson et al. | 254/134.3 FT |
| 2,444,252 | 6/1948 | Graham | 318/490 X |
| 2,671,192 | 3/1954 | Fleming | 318/490 X |
| 2,940,335 | 6/1960 | Mitchell | 318/490 X |
| 3,190,616 | 6/1965 | Oleson | 254/134.3 FT |
| 3,845,373 | 10/1974 | Totsu et al. | 361/31 X |

FOREIGN PATENT DOCUMENTS

| | | | |
|---|---|---|---|
| 44949 | 4/1977 | Japan | 254/274 |

*Primary Examiner*—Stuart S. Levy
*Assistant Examiner*—Joseph J. Hail, III
*Attorney, Agent, or Firm*—Edward J. Timmer

[57] ABSTRACT

The cable pulling device includes a control unit having a force indicator gauge and a switch and circuit breaker assembly in series in the hot wire to the electric motor which rotates the capstan for cable pulling. Power to the electric motor can thereby be interrupted manually or automatically in the event cable pulling force approaches an overload level where damage could occur to the device, accessories and/or cable. The control unit is detachable from the puller device for location close to the operator during a pull.

2 Claims, 6 Drawing Figures

CABLE PULLING DEVICE WITH FORCE INDICATOR AND OVERLOAD PROTECTION

This application is a continuation of application Ser. No. 435,172, filed Oct. 19, 1982, now abandoned.

FIELD OF THE INVENTION

The present invention relates to pulling systems and, in particular, to cable pulling systems for drawing cables, electrical wiring and the like through conduits, trays or raceways. Even more particularly, a cable pulling device is disclosed having force limiting means to protect against overloading of puller components, accessories and cable and force indicator means for visually displaying force exerted by the puller at a given moment during a pull.

BACKGROUND OF THE INVENTION

Cable pulling devices are well known and have been used in the construction industry to thread or draw electrical cable or wire through conduits, trays or raceways. Conventional cable pulling devices include a support frame, a capstan assembly rotatably mounted on the support frame and means on the support frame for rotating the capstan assembly. The means for rotating the capstan may be a manual crank or an electric motor coupled to a drive train. Typical cable pulling devices are illustrated in U.S. Pat. No. 2,221,903 issued Nov. 19, 1940 and U.S. Pat. No. 3,190,616 issued June 22, 1965.

In the past, cable pulling devices having an electric capstan driving motor have not included any means to limit the pull being exerted on the cable by the electric motor through the capstan. The operator must be careful to sense the cable pull force using his own experience to avoid overloading the cable puller components and accessories.

In the past, the support frame and puller support booms have been bent from exerting too great a pulling force. Prior cable pulling devices have not included convenient means by which the operator could visually monitor the pulling force being exerted during a pull. In pullers where a force monitoring device has been provided, use of the monitoring device has been limited to a fixed positional relationship between the pulling device and the operator.

SUMMARY OF THE INVENTION

Accordingly, the present invention has as an object the provision of a cable pulling device having overload protection means for limiting forces generated in and exerted on components of the device during the pulling operation to avoid damage thereto.

Another object of the invention is to provide such a cable pulling device with detachable and movable force indicator means for visually informing the operator as to the pulling force being exerted at a given moment.

Still another object of the invention is to provide a cable pulling device having the above capabilities but also having a control unit which is detachable from the pulling device and movable close to the operator for monitoring and controlling purposes.

Yet another object of the invention is to provide such a cable pulling device which is compact and easy to use in the field and rugged in construction.

In a typical working embodiment of the present invention, the cable pulling device is provided with force limiting means preferably in the power circuit to the electric motor. In a preferred embodiment, the force limiting means comprises a circuit breaker preferably of the slow reaction type in the hot wire to the motor and set to automatically interrupt power to the motor when pulling force exerted by the cable puller, as correlated with amperage drawn by the motor, approaches an overload level at which certain components or accessories of the cable pulling device would be damaged.

In a particularly preferred embodiment, the cable pulling device includes a control unit having a slow reaction circuit breaker and an on-off switch assembly and also having a force indicator means for providing a visual indication regarding pulling force being exerted at a given moment during a pull. Preferably, the indicator means comprises a suitably calibrated ammeter in series with the slow reaction circuit breaker/switch assembly in the hot line. The on-off switch is operable to manually interrupt power to the electric motor in the event overload is approached and to reset the circuit breaker. The control unit also includes means for removably attaching the control unit to the cable pulling device such that the operator can detach the control unit and locate it close to him during a pull.

DESCRIPTION OF PREFERRED EMBODIMENTS

Figure 1:
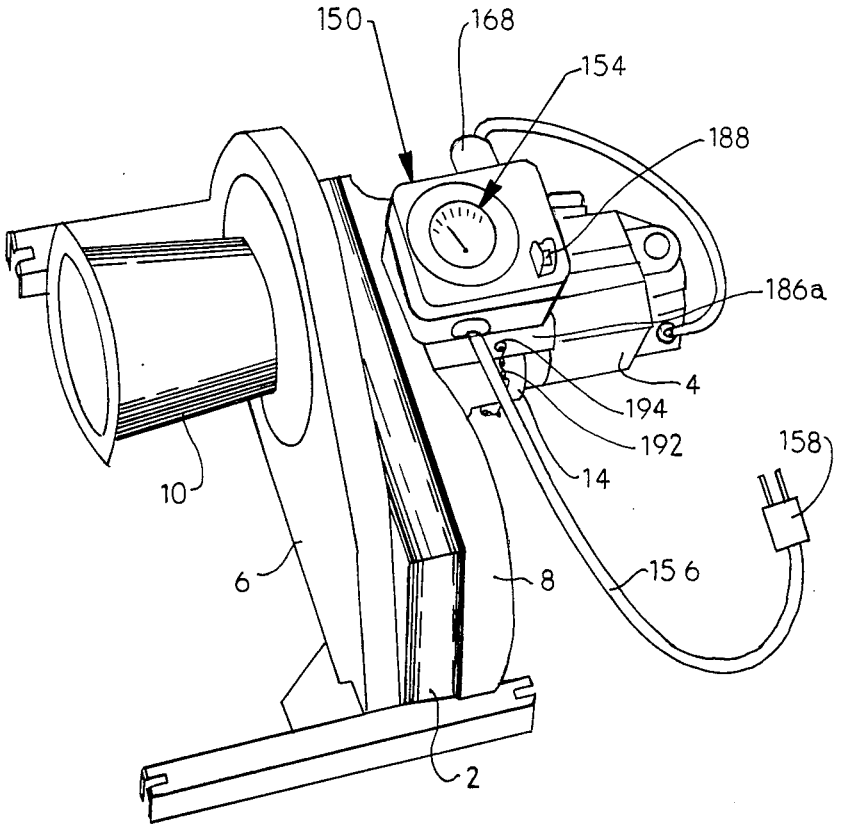
FIG. 1 is a perspective view of a cable pulling device showing the detachable control unit chained to the motor housing.
Figure 5:
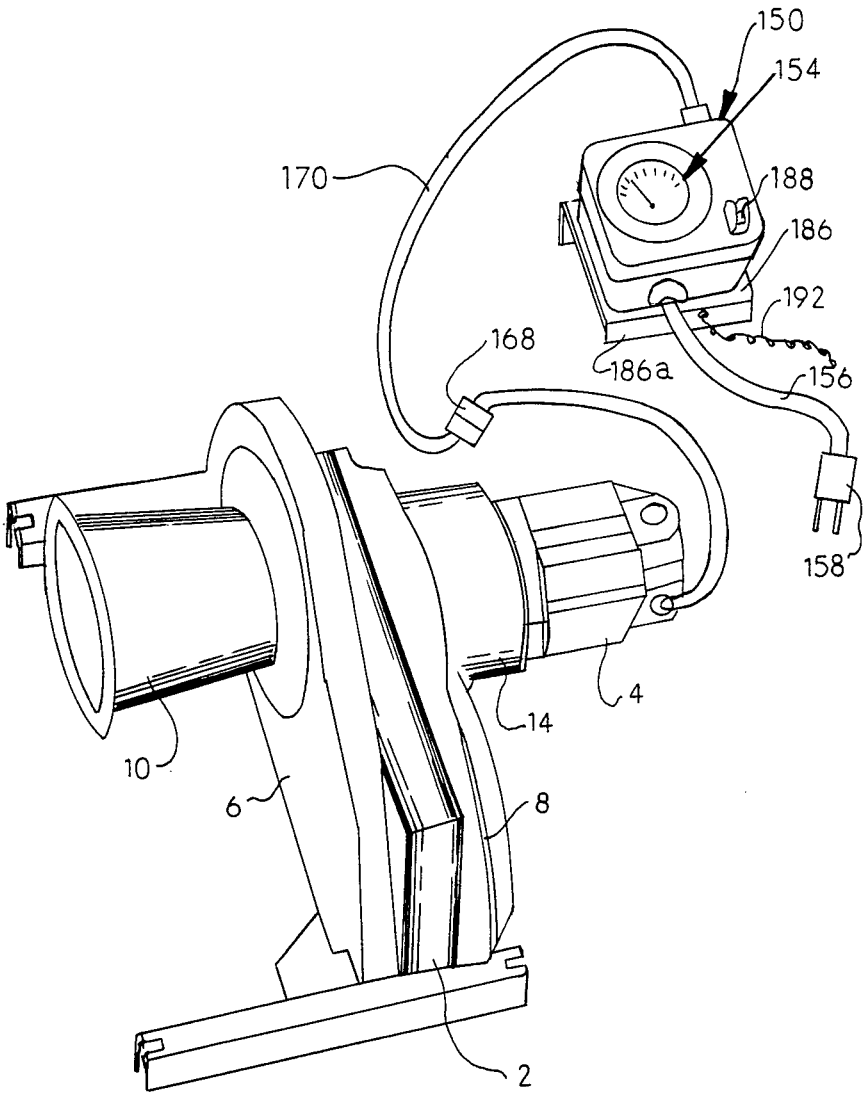
FIG. 5 is a perspective view of the cable pulling device with the control unit detached for operation of the cable pulling device from a remote location.

FIGS. 1 and 5 are perspective views of the cable pulling device constructed in accordance with a preferred embodiment of the invention. The cable pulling device is shown as including a steel support frame 2, an electric driving motor 4, enclosed chain and sprocket drive trains 6 and 8 and a rotatably mounted capstan 10 around which the cable pulling rope is wrapped. The control box 150 is shown in FIG. 1 attached to the motor 4 and in FIG. 5 detached.

Figure 2:
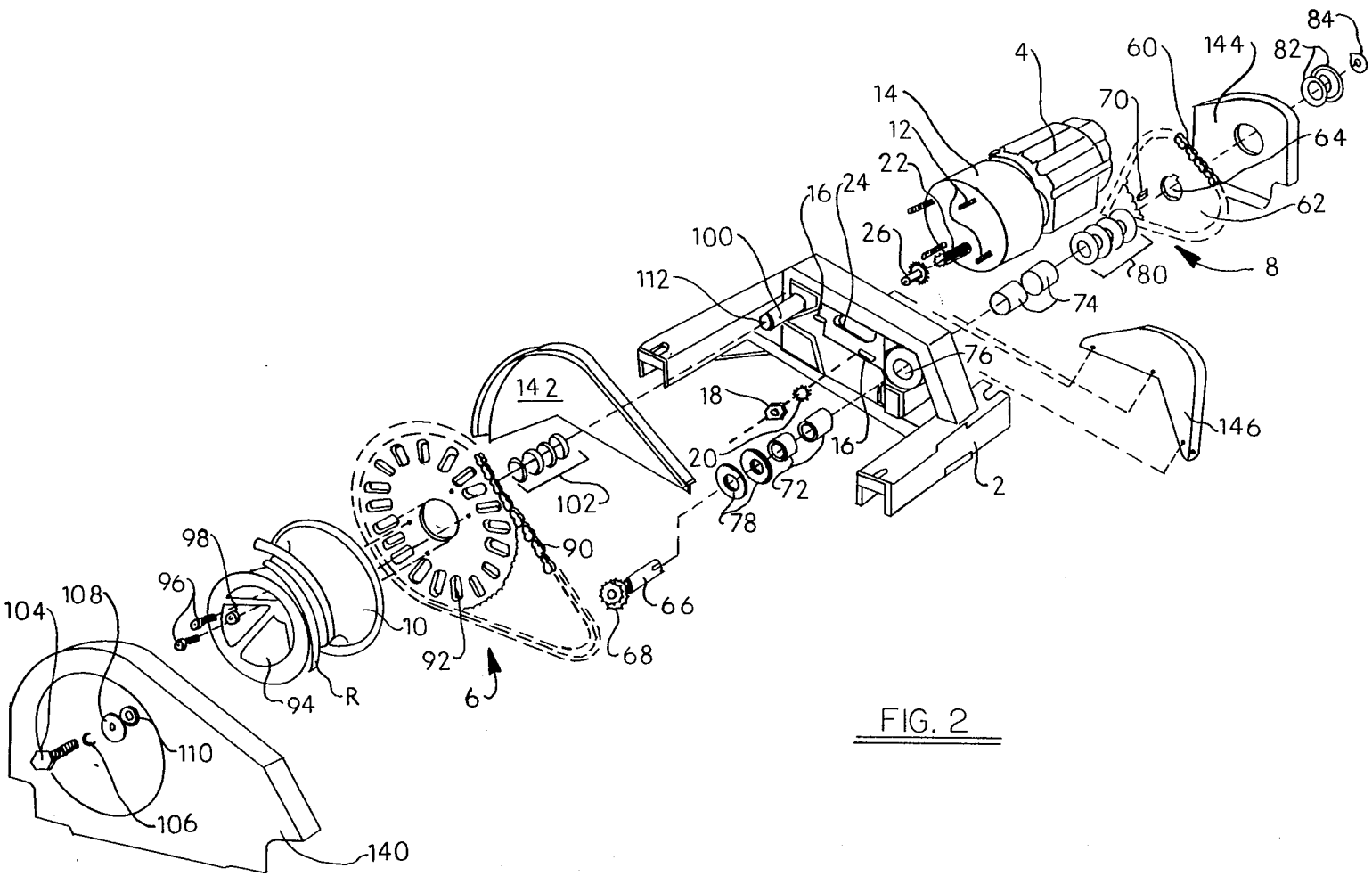
FIG. 2 is an exploded view of the cable pulling device without the control unit showing internal features thereof.

FIG. 2 is an exploded view showing the internal construction of a preferred cable pulling device without the control unit 150. In this figure, the electric driving motor 4 is a conventional 120 volt electric motor of 1½ horsepower and is securely mounted to the support frame 2 by a plurality of threaded studs 12 extending from the motor housing 14. The threaded studs 12 are received in corresponding slots 16 (only two shown) in the support frame and lock nuts and washers 18 and 20, respectively, (only one pair being shown) are used to secure the studs 12 to the motor housing. The motor housing includes a splined output shaft 22 which extends through slot 24 in the support frame and is drivingly received in sprocket 26 of the chain and sprocket mechanism 8.

As will be apparent from FIG. 2, the sprocket 26 is operatively engaged to drive chain 60 which in turn drives large sprocket 62. The large sprocket 62 includes a central, keyed hole 64 in which counter shaft 66 carrying sprocket 68 is received and keyed by key 70. The shaft 66 is rotatably received in a pair of inner races 72. Needle bearings 74 are positioned between inner races 72 and outer race formed by bore 76 in the support frame 2. Inboard thrust washers 78 and outboard thrust washers 80 are provided on shaft 66 for conventional purposes. And, washers 82 and retainer ring 84 are also provided to hold the aforementioned components on shaft 66 in usual fashion.

It is apparent that sprocket 68 is meshed with drive chain 90 engaging large capstan drive sprocket 92. The sprocket 92 is fastened to capstan hub 94 by multiple machine screws 96 and lock washers 98 to drive same. The capstan 10 is itself rotatably mounted to spindle 100 on the support frame 2 with thrust washers 102 and capstan retaining screw 104, lock washer 106, washer 108 and shim washer 110. To this end, the spindle 100 includes a threaded hole 112 in its axial end to receive screw 104.

As shown in FIG. 2, outer and inner guards 140 and 142 are provided to enclose chain and sprocket mechanism 6 while outer and inner guards 144 and 146 are provided for chain and sprocket mechanism 8.

Figure 3:
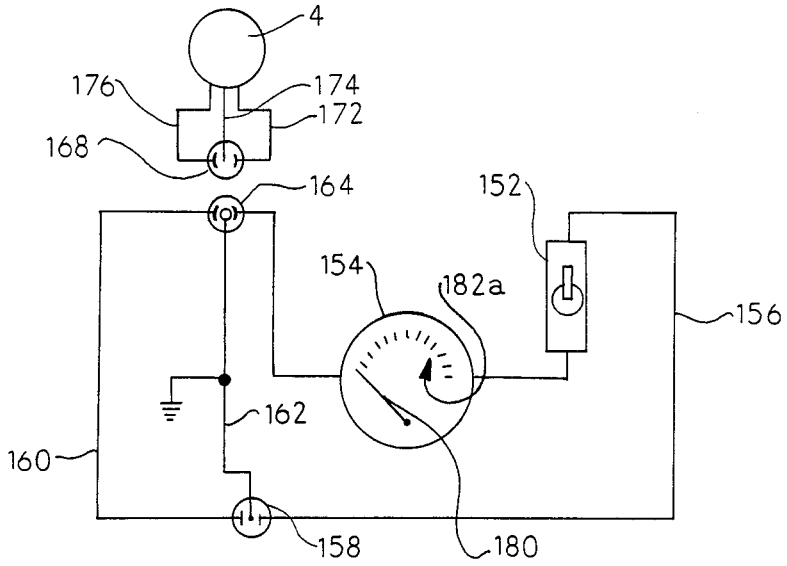
FIG. 3 is a circuit schematic showing the slow reaction circuit breaker and force indicator in series in the hot line to the electric motor.
Figure 4:
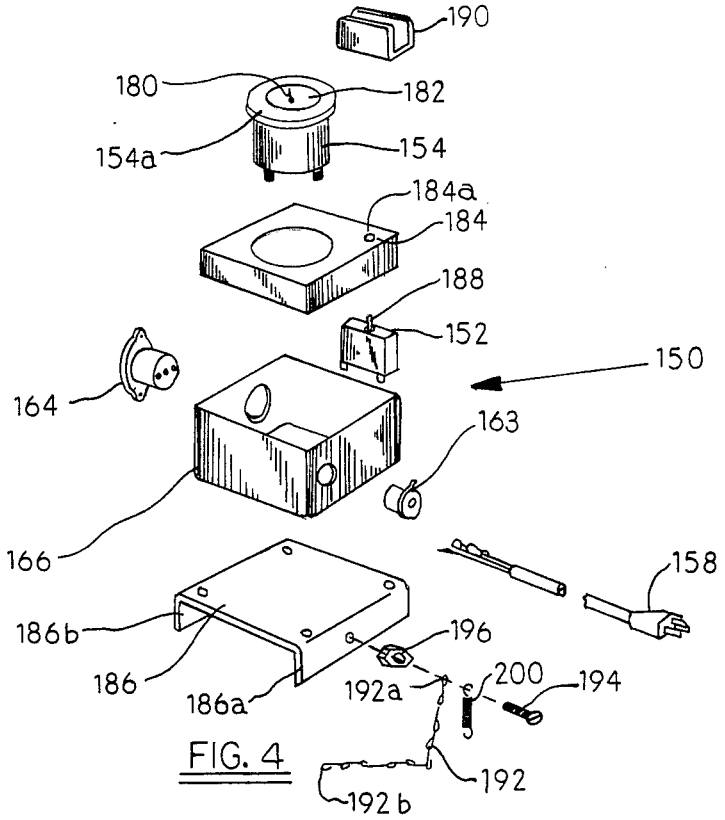
FIG. 4 is an exploded view of the control unit.

With reference to FIGS. 3 and 4, the control unit 150 is shown including a switch and circuit breaker assembly 152 and force indicator gauge 154 in series in the hot wire 156 of the power cord 158. Of course, power cord 158 also includes a neutral wire 160 and ground wire 162 as is customary for cable pulling devices. The power cord 158 is received in a bushing 163 extending toward an electrical connector 164 in the control box 166 of the control unit. The power cord 168 from electric motor 4 is received in connector 164 when the control unit is attached on the motor housing 14 as shown in FIG. 1. When the control unit 150 is removed for location closer to the operator, as shown in FIG. 5, an extension cord 170 is adapted to be plugged into connector 164 at one end and to receive plug 168 at the other end. Of course, the motor power cord 168 includes a corresponding hot wire 172, neutral wire 174 and ground wire 176.

A suitable switch and circuit breaker assembly 152 is commercially available from Airpax Corporation, Cambridge, Mass. (Model UPG-6-1-64-173-01) and is designated to trip or open circuit when an amperage of 20 amps is drawn by the electric motor 4. This amperage would correspond to a pulling force of 6500 pounds on the pulling rope, R.

The force indicator 154 comprises a conventional ammeter calibrated to display pulling force in response to amperage drawn by the electric motor 4 during a pull. The ammeter includes a hand 180 and face 182 with a pulling-force scale **182*a* so that by watching the hand relative to the scale, an operator can visually determine the pulling force being exerted. Those skilled in the art will recognize that known empirical techniques can be used to provide the proper pulling-force scale 182*a*** for use with a particular cable pulling device and electric motor. A preferred scale would be color-coded, e.g., 0 to 4500 lbs. would have a green background, 4500 to 6500 lbs. a yellow background and above 6500 lbs. a red background.

Figure 6:
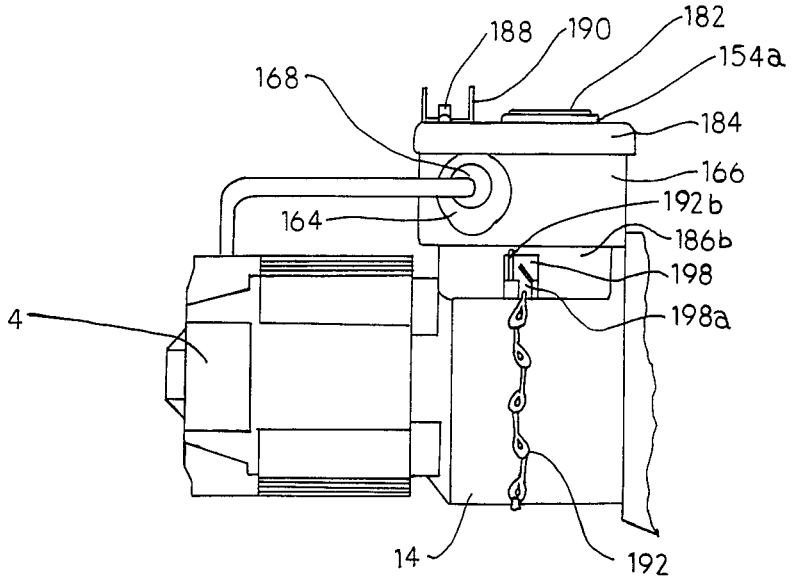
FIG. 6 is a partial elevation of the control unit and attachment chain releasably attached thereto around the motor housing.

FIG. 4 illustrates that the control unit 150 includes a control box top 184 for engagement onto the control box 166 by any known means. The force indicator gauge 154 has a flange **154*a* which is fastened to top 184 in any suitable fashion. A hole 184*a* is provided in the box top to allow toggle switch 188 to extend thereabove for manual actuation. A switch guard 190 is also screwed to top 184 to shield the toggle switch 188 from accidental actuation. The control box 166 in turn is fastened to a mounting base or plate 186 by screws and nuts in known manner. The mounting plate 186 has depending flanges 186*a* and 186*b* which are spaced apart sufficiently to straddle the cylindrical motor housing 14 as shown in FIG. 1. An attachment chain 192 is provided and extends around the motor housing 14 when the control unit 150 is attached thereto with one end 192*a* of the chain being fastened to flange 186*a* by screw 194 and nut 196 and the other end 192*b* of the chain removably attached in a slotted bracket 198 on flange 186*b*, FIG. 6. A spring 200 is connected to the shaft of screw 194 at one end and to an appropriate link of the chain 192 to maintain chain tightness around the cylindrical motor housing 14**.

The control unit 150 is removed from the cable pulling device simply by releasing end **192*b* of the attachment chain 192 from the slot 198*a* of the bracket 198. Extension cord 170 can then be inserted between connector 164 and power cord 168, FIG. 5**. The operator can thereby monitor and control the device at close range.

It will be apparent to those skilled in the art that during a pull, the operator can manually interrupt power to motor 4 in the event the force indicator gauge 154 indicates the approach of overload conditions. Also, the circuit breaker assembly 152 will automatically interrupt power to the motor in an overload condition if for some reason the operator fails to do so. To resume pulling after the circuit breaker described has interrupted power to the motor, the operator merely pushes the toggle switch back to the "on" position. However, in an overload situation, the circuit breaker assembly cannot be overridden by holding the toggle switch in the "on" position.

Another advantageous feature of the invention is that the control unit 150 can be rotated on the motor housing 14 when releasably attached thereto by chain 192 to provide the best viewing angle for the operator if he chooses not to remove the unit.

While the invention has been described by a detailed description of certain specific and preferred embodiments, it is understood that various modifications and the like can be made in them within the scope of the appended claims which are intended to also include equivalents of such embodiments.

I claim:

1. A cable pulling device comprising a support frame, a capstan means rotatably mounted on the support frame, driving means for rotating the capstan means to exert a cable pulling force, said driving means including an electric motor means mounted on the support frame and a control unit connected in the hot line to the electric motor means for monitoring the cable pulling force and interrupting power to the electric motor when cable pulling force approaches an overload level where damage could occur to the cable pulling device, said control unit including a control box, an ammeter means on the control box calibrated to visually display cable pulling force in response to a given amperage drawn by said motor, circuit breaker means on the control box for automatically interrupting power to said motor when overload is approached and on-off switch means on the control box for manually interrupting power to said motor means and for resetting said circuit breaker means in the event it is actuated by overloading pulling forces, and a pair of spaced apart flanges on the control box spaced sufficiently to supportingly straddle the electric motor means including chain means having one end fixedly connected to one flange and another end removably connected to the other flange with the chain means extending around the electric motor between said flanges for releasably and rotatably mounting the control box on the electric motor means so that an operator can detach and move the control box for monitoring and controlling the cable pulling device close to the operator when said operator is remote from the cable pulling device and so that the operator can adjust viewing angle of said control unit when it is mounted on the cable pulling device.

2. The cable pulling device of claim 1 wherein the control box further includes an electrical connector thereon releasably connectable to a plug on the power cord to the electric motor means when the control box is removably mounted on the cable pulling device and releasably connectable to the plug of an extension when the control box is removed from the cable pulling device, said extension having an electrical connector on the other end releasably receiving said plug of said motor power cord when said control box is removed from the cable pulling device.

* * * * *